United States Patent [19]

Ohmori

[11] 4,274,622

[45] Jun. 23, 1981

[54] DEVICE FOR SEPARATING SLAG FROM MOLTEN BATH

[75] Inventor: Hisashi Ohmori, Kurashiki, Japan

[73] Assignee: Kawasaki Steel Corporation, Kobe, Japan

[21] Appl. No.: 105,721

[22] Filed: Dec. 20, 1979

[30] Foreign Application Priority Data

Jan. 11, 1979 [JP] Japan ..... 54-955

[51] Int. Cl.[3] ..... F27D 3/14

[52] U.S. Cl. ..... 266/227; 266/195; 75/24

[58] Field of Search ..... 75/24, 46; 266/227–230, 195

[56] References Cited

U.S. PATENT DOCUMENTS

| | | | |
|---|---|---|---|
| 463,514 | 11/1891 | Keiper | 266/229 |
| 3,433,472 | 3/1969 | Chang et al. | 266/195 |
| 3,476,549 | 11/1969 | Glaesener | 75/46 |
| 4,169,723 | 10/1979 | Fernandes | 75/41 |

*Primary Examiner*—M. J. Andrews

*Attorney, Agent, or Firm*—Balogh, Osann, Kramer, Dvorak, Genova & Traub

[57] ABSTRACT

A device for separating slag from molten bath to be discharged from a container, for example, a converter, ladle or the like comprising a tortuous molten bath discharge passage communicated with the container and shaped and arranged such that the static pressure of that portion of the molten bath which is remained in the tortuous molten bath discharge passage after the molten bath has been discharged from the container is kept in balance with the static pressure of the slag following the flow of the molten bath.

5 Claims, 11 Drawing Figures

DEVICE FOR SEPARATING SLAG FROM MOLTEN BATH

BACKGROUND OF THE INVENTION

1. Field of the Invention

This invention relates to a device for separating slag from molten bath to be discharged from a container, for example, a converter, ladle or the like.

2. Description of the Prior Art

During discharging molten bath from a container, for example, a converter, ladle or the like for enclosing molten metals or alloys and slag floating on and covering the free surface of the molten bath, and, particularly, at the end of the discharging, the slag is often mixed into the molten bath. In general, it is difficult to prevent the slag from mixing into the molten bath.

That is, in the converter, for example, when the discharging of the molten steel approaches to its end, a flow of molten steel is biased toward the edge of a receiving ladle. Under such condition, if a flow of slag is detected in the receiving ladle, the converter is returned to its original vertical position and the slag is removed out of the receiving ladle. In such operation, the mixing of the slag into the molten steel is also unavoidable.

It has also been proposed to use a refractory spherical body having a specific gravity which is the intermediate between a specific gravity of molten steel and that of slag and float it in the molten steel bath and cause it to accompany the flow of molten steel at the end of discharging the molten steel and clog a molten steel discharge hole. But, the use of such measure is not reliable in practice and ensures no desirous complete closure of the molten steel discharge hole.

In the course of discharging the molten steel from the converter, the converter may be returned to its original vertical position to retain the molten steel in the converter or the molten steel may be discharged from a ladle with the aid of a stopper rod or sliding nozzle so as to remain the molten steel in the ladle. But, the use of such measures provides a material decrease in yield.

In addition, the slag mixed into the molten bath as described above functions to decrease the yield of alloys or iron alloys to be added to the molten bath during its discharge and damage the refractory material of the ladle. Moreover, in the case of manufacturing an ingot, the slag mixed into the molten bath considerably deteriorates the quality of the steel ingot.

SUMMARY OF THE INVENTION

An object of the invention, therefore, is to provide a device for separating slag from molten bath which is simple in construction and which can reliably separate the slag from the molten steel.

A feature of the invention is the provision of a device for separating slag from molten bath comprising a molten bath container for enclosing therein molten bath composed of a molten metal or alloy and a slag floating on and covering the free surface of the molten bath, and a tortuous molten bath discharge tubular passage communicating with the container and located in a plane crossed with a horizontal plane when the container is brought into its molten bath discharge position, the tortuous molten bath discharge passage being so shaped and arranged that the static pressure of that portion of the molten bath which has remained in the tortuous molten bath discharge passage after the molten bath has been discharged from the container is kept in balance with the static pressure of the slag following the flow of the molten bath, thereby preventing discharge of the slag out of the tortuous molten bath discharge passage.

Further objects and features of the invention will be fully understood from the following detailed description with reference to the accompanying drawings, wherein:

DETAILED DESCRIPTION OF THE PREFERRED EMBODIMENTS

In the present invention, it is recognized that there is a difference between a specific gravity of slag and that of molten bath and provision is made of a device for separating slag from molten bath which can prevent the slag in the rear of the flow of molten bath from discharging out of a container by means of a static pressure in the rear of the flow of molten bath on the basis of the above mentioned recognition.

In the specification, the molten bath container shall be understood to mean not only a furnace body for melting or refining metals, alloys or the like but also a usual molten bath container for manufacturing ingots or any other ladles.

Figure 1:
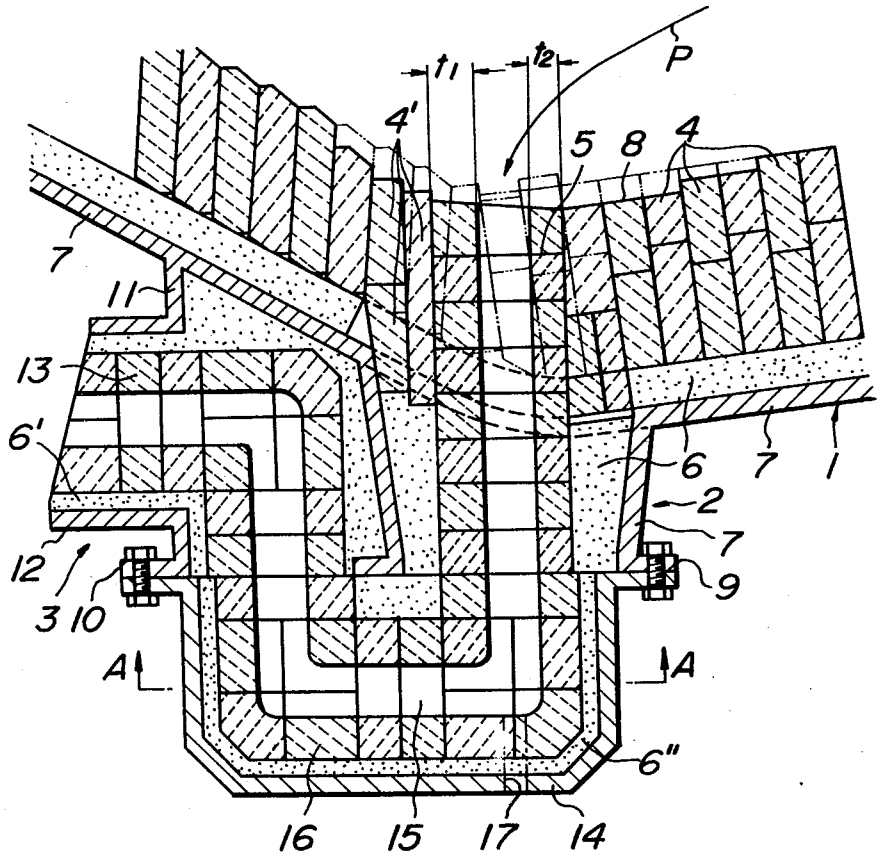
FIG. 1 is a partial cross-sectional view of one embodiment of a device for separating slag from molten bath for a converter according to the invention.

FIG. 1 shows one embodiment of a device for separating slag from molten bath for a converter according to the invention. In FIG. 1, reference numeral 1 designates a furnace body of the converter located at a molten bath discharging position, 2 a molten bath discharge opening and 3 a device for separating slag from molten bath according to the invention detachably secured to the molten bath discharge opening 2.

The furnace body 1 is usually provided at its shoulder portion near a furnace opening with the molten bath discharge opening 2 which becomes faced downwardly when the furnace body 1 is brought into its molten bath discharging position shown in FIG. 1. Referring to FIG. 1, reference numeral 4 designates an inner lining brick, 5 a molten bath guide brick, 6 a castable refractory material and 7 an iron cover plate. The inner lining brick 4 is provided at that portion thereof which is faced to the center of the molten bath discharge opening 2 with a depression 8. The molten bath guide brick 5 is terminated at the depression 8 and composed of square bricks each having a circular hole and superimposed one upon the other. Between the molten bath guide brick 5 and the inner lining brick 4 are sandwiched deformed bricks 4' surrounding the molten bath guide brick 5. The deformed bricks 4' function to firmly bond the molten bath guide brick 5 with the inner lining brick 4.

It is preferable that a hole of the molten bath guide brick 5 is deviated toward the furnace base side, that is, that side of the furnace body 1 which is opposite to the furnace opening, and that the thickness $t_1$ of the furnace opening side of the molten bath guide brick 5 is made larger than that thickness $t_2$ of the furnace base side, of the molten bath guide brick 5, thereby making the life of the molten bath guide brick 5 long against corrosion due to the molten bath struck against it as shown by an arrow P.

In the present invention, the iron cover 7 is provided at the lower end of the molten bath discharge opening 2 with an outwardly extending flange 9. In addition, to the iron cover 7 is secured a bracket 11 having a fitting edge 10 aligned with the flange 9 and distant apart from the molten bath discharge opening 2.

Figure 2:
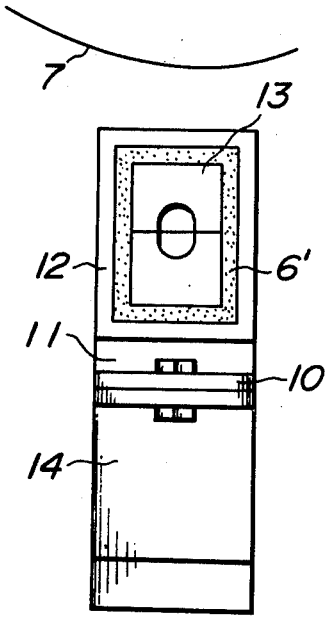
FIG. 2 is an end view of a molten bath discharge hole shown in FIG. 1.
Figure 3:
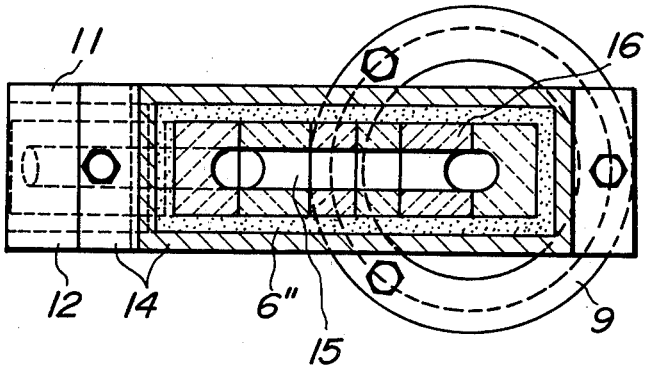
FIG. 3 is section on line A—A of FIG. 1.

The bracket 11 is provided with a rectangular iron cover portion 12 which is oblique in section as shown in FIG. 2 and provided therein with hook-shaped direction changing bricks 13 assembled and communicated with the molten bath discharge opening 2 and held by a castable refractory material 6'.

Across the flange 9 and the fitting edge 10 is detachably fastened a box-shaped iron cover 14 by means of bolts and nuts. The box-shaped iron cover 14 is provided therein with the molten bath guide brick 5, direction changing brick 13 and direction inverting brick 16, held by a castable refractory material 6''.

Figure 4A:
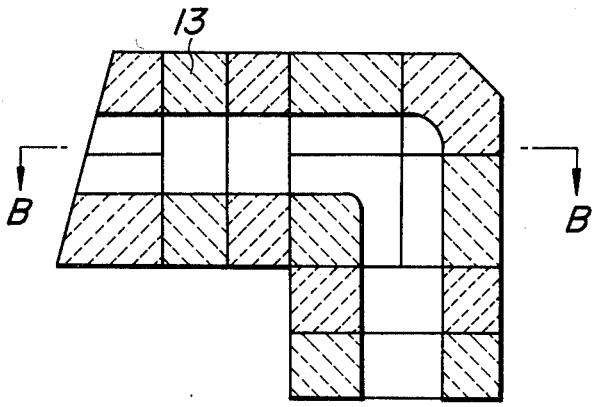
FIG. 4*a* is a cross-sectional view of a direction changing brick shown in FIG. 1.
Figure 4B:
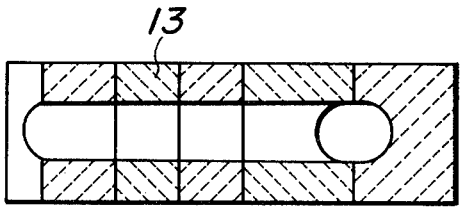
FIG. 4*b* is a section on line B—B of FIG. 4*a;*
Figure 4C:
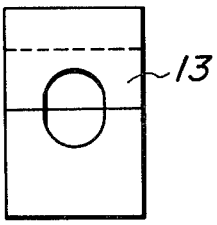
FIG. 4*c* is an end view of the direction changing brick shown in FIG. 4*a;*
Figure 5A:
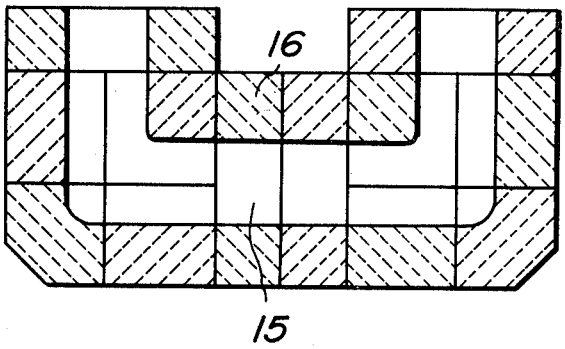
FIG. 5*a* is a cross-sectional view of a direction inverting brick shown in FIG. 1.
Figure 5B:
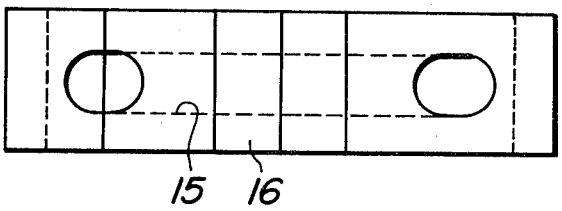
FIG. 5*b* is its plan view.

FIGS. 4*a*, 4*b* and 4*c* diagrammatically illustrate the gist of assembling the direction changing bricks 13, while FIGS. 5*a* and 5*b* diagrammatically illustrate the gist of assembling the direction inverting bricks 16.

It is clear that, when the converter is brought into its molten bath discharging position shown in FIG. 1, the molten steel in the furnace is discharged from the molten bath guide brick 5 through a molten bath discharge tubular passage 15 located beneath the converter and defined by the direction inverting brick 16 and direction changing brick 13 to a molten steel ladle (not shown). In this case, the molten steel in the furnace has a specific gravity of the order of about 6.8 and the slag floating on and covering the free surface of the molten steel has a specific gravity of about 2.5.

Figure 6:
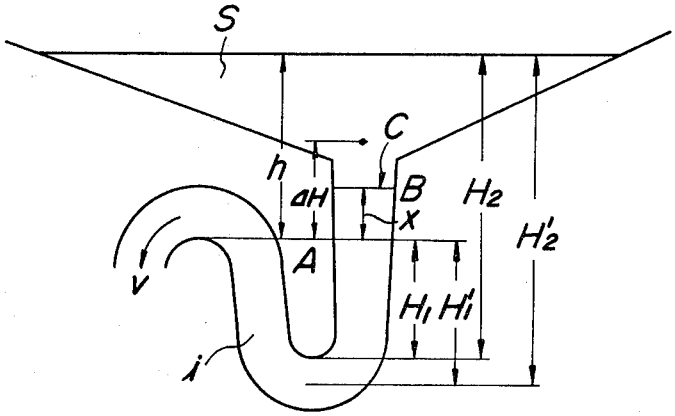
FIG. 6 is a diagrammatic view showing the embodiment of the invention shown in FIG. 1 and explaining the principle of separating slag from molten steel.
Figure 7A:
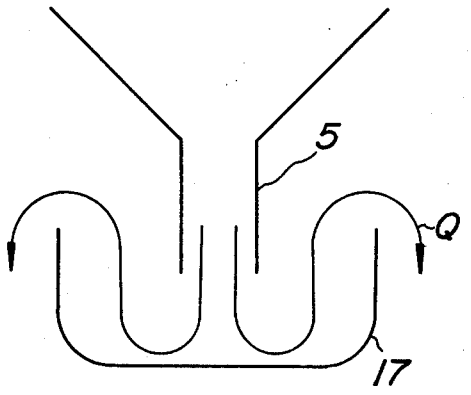
FIGS. 7*a* and 7*b* are diagrammatic views showing modified embodiments of the invention.
Figure 7B:
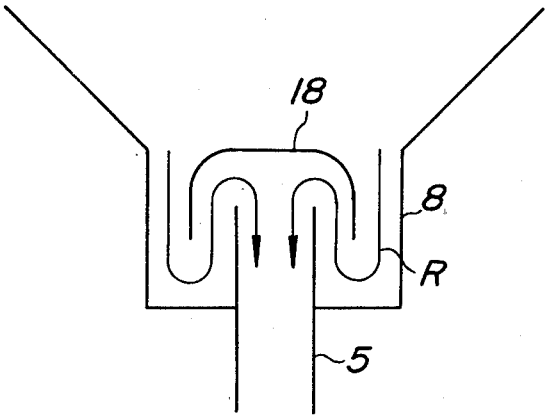

FIG. 6 diagrammatically shows the device according to the invention shown in FIG. 1. In FIG. 6, if an interface C between the molten steel i and the slag s arrives at a point B, the flow speed U of the molten steel is given by $$U = \sqrt{2g\Delta H}$$

where ΔH is a sum of an iron column x and a slag column ($H_2$-$H_1$-x) whose specific gravity 2.5 is corrected on the basis of the specific gravity of iron 6.8, that is, $$\Delta H = x + (H_2 - H_1 - x) \cdot \frac{2.5}{6.8}.$$

Now, $H_2$-$H_1$=h is physically determined by taking the construction of the furnace body into consideration. Let h=2.0 m, then ΔH is given by $$\Delta H = (2.0 - x)\frac{2.5}{6.8} + x$$

Hence, U is given by $$U = \sqrt{\frac{2g}{6.8}}\,(5 + 4.3x)$$

Let it be assumed that the discharge of the molten steel has been completed when U=0, then $$5+4.3\times=0$$

That is, $$x \cong -1.2 \text{ (m)}.$$

As seen from the above, if the interface C between the molten steel and the slag is lowered down from the point A to a point which is distant apart from the point A by 1.2 m, the flow speed of the molten steel becomes zero.

As a result, if $H_1$ is defined by the following formula $$H_1|x| = 1.2\ m,$$

then it is possible to automatically control the selective discharge of the molten steel separated from the slag.

In physical discussion, $H_1'$ and $H_2'$ shown in FIG. 6 are used in place of $H_1$ and $H_2$, respectively. But, in practice it is more safety to use $H_1$ and $H_2$. In addition, since the molten steel has a Kinetic energy during its discharge it is the safest measure to make $H_1$ larger by taking such Kinetic energy of the molten steel into consideration.

As seen from the above, in the present invention, the molten bath discharge tubular passage is U-shaped and stationary, being firmly secured to the molten bath container, and arranged such that the static pressure of the molten steel is kept in balance with the static pressure of the slag so as to prevent the slag from flowing after the molten steel, thereby selectively separating the slag from the molten steel.

The presence of the tortuous molten bath discharge passage makes it difficult to visually inspect the molten steel discharge hole. In order to visually inspect the molten steel discharge hole, provision may be made of an inspection hole 17 as shown by dot-dash lines in FIG. 1 and the inspection hole 17 may be closed by an inspection plug in the case of discharging the molten steel. Alternatively, the inspection hole 17 may be enlarged and provided with a slide gate. Such large inspection hole 17 may be made open prior to and during the middle discharge stage and the molten steel may be discharged therethrough. At the end of the discharge, the slide gate is closed so as to discharge the molten steel through the tortuous passage so as to separate the slag therefrom.

The cross-sectional area of the U-shaped molten bath discharge passage 15 may be made considerably larger than those of the molten bath guide brick 5 and the inlet portion of the direction inverting brick 16 on the one hand and may be made considerably larger than those of the outlet portion of the direction inverting brick 16 and the direction changing brick 13 on the other hand, thereby more effectively preventing the slag from mixing into the discharge molten steel.

The invention has been applied to the molten steel discharge hole provided in the converter. The invention may also be applied to a ladle provided at its base wall or side wall with a molten bath discharge opening adapted to be opened or closed by means of a stopper rod, rotary nozzle or slidable nozzle so as to easily prevent the discharge of the slag that tends to be mixed into the molten steel in the last discharging stage. Particularly, it is possible to prevent degradation in quality of a steel ingot to be manufactured due to the slag mixed therewith or prevent a continuous casting tundish from being mixed with the slag, thereby improving quality and yield of the product.

In the ladle for controlling opening and closing of the molten bath discharge opening by means of a rotary or slide nozzle, provision may be made of the above mentioned U-shaped trap type molten bath discharge passage made integral with the movable nozzle.

In the present invention, the tortuous molten bath discharge passage located in a plane crossed with the horizontal plane under the molten bath discharging position of the molten bath container shall be understood to cover not only the U-shaped passage but also all of such passages adapted to invert the direction of the down flow of molten steel and slag into raising flow and the change the direction into a transverse direction and again invert the transverse direction into the downward direction. For example, the lower end of the molten bath guide brick 5 may be extended into and distant apart from the bottom of a refractory cup-shaped body 17 as shown in FIG. *7a.* In the present embodiment, the raising flow of the molten bath overflows the peripheral edge of the refractory cup-shaped body 17 as shown by an arrow Q in FIG. *7a.*

Alternatively, the depression 8 provided in the inner lining brick 4 may be made large and the upper end of the molten bath guide brick 5 may be extended upwardly and covered with a refractory bell-shaped body 18, the upper end of the molten bath guide brick 5 being distant apart from the bottom of the refractory bell-shaped body 18. In the present embodiment, the raising flow of the molten bath overflows the peripheral edge of the upper end of the molten bath guide brick 5 as shown by an arrow R in FIG. *7b.*

As stated hereinbefore, the device for separating slag from molten bath according to the invention has a number of advantages. In the first place, the device is simple in construction. Secondly, the device can prevent the slag from mixing into the molten bath. Third, the device can control selective separation and discharge of the molten bath only by its own ability. Finally, the device can eliminate all of the drawbacks which have been unavoidably encountered by mixing of the slag into the molten bath.

What is claimed is:

1. A device for separating slag from molten bath for use with a molten bath container for enclosing therein a molten bath composed of molten metal and slag floating on and covering the free surface of said molten metal, said device comprising a member having a U-shaped refractory tubular passage firmly secured to a discharge outlet of said container, and stationarily disposed beneath said container, when said container is brought into its molten bath discharge position, said U-shaped refractory tubular passage being so shaped and arranged that the static pressure of that portion of the molten bath, which is in said U-shaped refractory tubular passage after said molten bath has been discharged from said container, is kept in balance with the static pressure of the slag following said flow of the molten bath, thereby preventing discharge of said slag out of said U-shaped refractory tubular passage.

2. The device according to claim 1, wherein said molten bath container is a converter.

3. The device according to claim 1, wherein said molten bath container is a ladle.

4. The device according to claim 1, wherein said tubular passage is integrally formed as a single unit.

5. The device according to claim 1, wherein at least one portion of said U-shaped tubular passage is made detachably mounted.

* * * * *